US006036627A

United States Patent [19]

De Bellis et al.

[11] Patent Number: 6,036,627

[45] Date of Patent: Mar. 14, 2000

[54] MACHINE FOR AUTOMATICALLY EJECTING, REVERSING AND POSITIONING HYGIENIC CAPS INSIDE COFFEE CUPS OR OTHER CONTAINERS, AND ITS MECHANISM

[76] Inventors: Lorenzo De Bellis, Via Tito Schipa, 24; Domenico De Bellis; Francesco De Bellis, both of Via Mastro Rocco, 57, all of I-70021 Acquaviva delle Fonti, Italy

[21] Appl. No.: 09/226,408

[22] Filed: Jan. 6, 1999

Related U.S. Application Data

[63] Continuation of application No. PCT/IT97/00174, Jul. 17, 1997.

[30] Foreign Application Priority Data

Jul. 19, 1996 [IT] Italy ..... BA96A0037

[51] Int. Cl.[7] ..... B31B 49/00

[52] U.S. Cl. ..... 493/6

[58] Field of Search ..... 493/6, 100, 101, 493/102, 103, 104, 108, 109

[56] References Cited

U.S. PATENT DOCUMENTS

| | | | |
|---|---|---|---|
| 1,703,637 | 2/1929 | Reifsynder . | |
| 3,715,853 | 2/1973 | Bemiss | 493/101 |
| 3,990,353 | 11/1976 | Richards et al. | 493/108 |
| 4,007,670 | 2/1977 | Albano et al. | 93/36.01 |
| 4,052,931 | 10/1977 | Morse et al. | 93/36.01 |
| 4,070,953 | 1/1978 | Richards et al. | 493/109 |
| 4,619,636 | 10/1986 | Bogren | 493/103 |
| 5,046,633 | 9/1991 | Chung | 220/407 |
| 5,481,847 | 1/1996 | Lockington | 493/100 |
| 5,679,109 | 10/1997 | Gics | 493/100 |

FOREIGN PATENT DOCUMENTS

| | | |
|---|---|---|
| 11822 | 8/1912 | United Kingdom . |
| 95/10966 | 4/1995 | WIPO . |
| 9510966 | 4/1995 | WIPO . |

*Primary Examiner*—Eugene L. Kim
*Attorney, Agent, or Firm*—Ladas & Parry

[57] ABSTRACT

A machine for ejecting, inverting and positioning a hygienic cap (18), made of plastic or similar material, inside a coffee cup (19) or similar container having a suction hole (20) in its bottom, so that the cap perfectly lines the cup and its rim and prevents direct contact of the liquid and the user's lips with the cup. The machine provides a completely automatic lining of the cup whereby once the cup (19) to be lined is positioned on its base (14), a mechanism is activated, which ejects the cap and inserts it perfectly into the cup whereafter the machine stops, the mechanism is interrupted and is started again as soon as the lined cup is removed and replaced with a new cup.

4 Claims, 2 Drawing Sheets

MACHINE FOR AUTOMATICALLY EJECTING, REVERSING AND POSITIONING HYGIENIC CAPS INSIDE COFFEE CUPS OR OTHER CONTAINERS, AND ITS MECHANISM

This application is a continuation of PCT/IT97/00174 filed Jul. 17, 1997.

TECHNICAL FIELD

This invention relates to a machine which ejects, reverses and positions hygienic caps inside china or ceramic cups or other types of containers to line these cups or similar containers, and a mechanism which ejects and reverses the hygienic cap used for lining cups or the like.

The invention relates to the technical field of machines, in particular machines and devices for preparing coffee, but cannot be classified as one of the existing machines because it has a unique function. This electromechanical machine, which will be used mainly in the refreshment sector, lines the inside and rim of coffee cups or similar, pierced at the bottom, with a hygienic plastic film cap.

BACKGROUND ART

At present, machines for lining cups or other containers by ejecting, reversing and positioning hygienic caps so that the caps adhere perfectly and line both the inside and the rim of the cups, are not available.

A hygienic cap is disclosed in Italian patent no. 01268455, and its sucessor patent application PCT/IT94/00172, the cap being positioned in the cup manually by putting it inside and pushing it down so that the hygienic cap adheres perfectly, lining the inside of the cup. According to the patent and the PCT application, the cup or similar container has a hole in the bottom so that all the air can flow out when the cap is pressed inside, thus obtaining perfect adherence and optimal lining.

The operation of lining, which hygienically isolates the cup to prevent direct contact between the container and the substance it contains and the user's lips, is, however, awkward and not completely hygienic as the cap touches the supporting surface and so protection becomes less effective.

SUMMARY OF THE INVENTION

The primary aim of this invention is to obtain an automatic insertion of the protecting cap into the cup for lining its inside and rim. This target has been reached, according to the invention, with a technical solution consisting of a machine and an ejecting and reversing mechanism of a hygienic cap and the consequent lining of the cup.

The advantages of this invention essentially consist of the fact that the hygienic plastic cap (or similar material) is automatically ejected and simultaneously reversed; that the hygienic cap is inserted automatically and adheres to the inside of the cup without requiring manual intervention; that the entire operation occurs in absolutely hygienic conditions without any contact with the environment; that the operation is rapid and easy; that it assures a perfect adherence of the cap to the cup; that the applied cap is almost imperceptible.

The mechanism and the machine have been designed for ejecting and reversing the above-said hygienic cap to be inserted into coffee cups as a hygienic protection, but the mechanism can also be used for reversing and ejecting other types of containers and cups provided that they have a rim, as well as f or lining both traditional coffee cups and other containers with a hygienic cap, by adapting the machine's dimensions proportionally to the type of container to be ejected and reversed.

The essential structure of a machine for ejecting, reversing and positioning a hygienic cap on a cup or another container to line it, according to the invention, comprises the following components:

- means for carrying the cap and causing it to fall upside-down (3), with a fixed internal cylinder (2) having a slightly cone-shaped lower end (4), this shape exerting a slight pressure on the rim of the cap to be ejected (5) so that the tabs (8) can grip it easily for its ejection;
- means for ejecting the cap, with the tabs (8) pushed down by the downward stroke of an external movable cylinder (1) forming an integrated part with them, the tabs slipping in one or more slots (6) in the terminal part of the fixed cylinder (2);
- means for reversing (17) the cap during its ejection (18) so that it is positioned perfectly inside a cup or similar by a 180° rotation;
- means for lowering the external cylinder (1) as a consequence of the pressure exerted on its top end (9), which presses the springs (10); after its down stroke, the external cylinder (1) returns to its upper position, pushed up by the springs (10) which had previously been compressed due to the down stroke and are now allowed to return to their initial position;
- means to exert pressure on the external cylinder (1);
- means to stop this pressure just when the cup (19) is perfectly lined with the hygienic cap.

The invention offers the advantage that the pressure on the external cylinder (1) is obtained by compressed air fed through a duct (12); the compressed air is produced by a microcompressor (13) started by a special electric circuit which is triggered by an electronic station (16) working consequently to the opening of a microswitch (15); microswitch 15 opens when the cup (19) is positioned on its base (14).

Another advantage is that a vacuum sensor (22) interrupts pressure to the cylinder; this sensor perceives the absence of air thanks to a hole in the base (21) and at the bottom of the cup (20), and commands station 16 to shut off microcompressor 13, thus assuring perfect lining of the cup.

The invention has the advantage of an external cylinder moving vertically along the outside of the fixed cylinder and resting on a series of springs (10) which are pressed by the movable cylinder's (2) down stroke caused by the pressure exerted on its top end (9).

Another advantage of the invention is that movable cylinder 1 moves up again after the ejection of the cup (18) as the exceeding pressure is discharged through a pressure release valve (11) so that springs 10 return to their normal position.

The invention offers the advantage that one or more tabs (8) are used for ejecting the cap, which are integrated in the external cylinder and slip into slots (6) cut in the fixed cylinder's terminal part. Another advantage according to the invention is that the cups or other containers used have a hole in the bottom, and the caps correspond perfectly to these containers so that they adhere to their inside.

The invention also offers the advantage of a vacuum sensor (22) located in the air suction duct in a position corresponding to the holes (20, 21) of the cup and the base, which are connected to each other. The cap ejecting and reversing mechanism for lining the inside of coffee cups or other containers with the cap, includes the following stages:

positioning of the cup, with hole 20 in its bottom, on a base (14) having another hole (21), and simultaneous start of a system causing a thrust on the external cylinder (1), this system using a mechanical, electrical, electronic, pneumatic or another type of mechanism;

activation of means thrusting one of the caps (5), put in a stack (3) inside a cylinder with a slightly cone-shaped lower end, thanks to the force exerted on the cap's rim by one or more tabs (B);

means for reversing (17) the cap which falls down, thanks to its weight, into the container below;

lining of cup 19 with the inserted cap by suction the air through a special duct with a microcompressor (13) or a similar system;

shutting off the system when the cup is completely lined;

restart of the entire system cycle after the removal of the lined cup and its replacement by a new cup to be lined, which also has a hole at the bottom. The system can be shut off by interrupting the operation of microcompressor 13 when vacuum sensor 22 signals the absence of air to station 16; this occurs when the cup is perfectly lined.

The above described machine works as follows:

The cup to be lined is positioned in a special case (14) in the machine; a microswitch (15) is engaged mechanically by this positioning, which is electrically connected to an inlet port of the electronic station (16) which, as soon-as it receives the signal that the electrical contact is closed, energizes a relay supplying microcompressor 13 with current.

Microcompressor 13 produces a flow of compressed air passing through a flexible duct (12) to a special mechanical device and causing this device to release one single plastic cap from the cap stack (3).

The releasing mechanism is essentially composed of two cylinders; the external movable cylinder (1) moves vertically along the outside of the fixed internal cylinder (2).

The above-said internal cylinder (2) contains the reversed plastic caps put in a stack (3), which fall down thanks to their weight and stop in the lower part of the cylinder with a slightly cone-shaped end (4), especially designed so that the lowest cap (5) in the stack sticks out from the cylinder by about half the height of its rim.

In the lower cone-shaped part of the cylinder there are also two or more slots or openings (6) placed symmetrically relative to the vertical axis (7), which can recive two tabs (8) used for releasing the cap (5).

These tabs (8), forming the terminal part of the external cylinder (1), are also placed symmetrically relative to the vertical axis and slip in the above-said openings (6); in correspondence with these slots, the rim of the cap (5) tends to deform towards the outside by the effect of the radial force due to the cone shape and of the axial force produced by the stack's weight together with the material's natural elasticity, thus causing a bulge where tabs 8 can easily grip the cap and eject it when the external cylinder moves down.

Indeed, the axial force, caused by the force which develops through the compressed air on the top (9) of the movable cylinder (1), pushes this cylinder down together with the two releasing tabs (8) (these being an integral part of it) which carry cap 5 down until it is released from stack 3.

The compressed air is also capable of overcoming the forces opposed by the springs (10) placed around the mobile cylinder's girth; the springs are compressed by the cylinder when it moves down and are then released, forcing the cylinder to return to its rest position after the releasing stage when a special rapid pressure release valve (11), placed on the microcompressor's (13) outlet duct (12), opens and releases the air into the atmosphere.

The cap (5), once released (18), falls downwards because of its weight and, as it does so, is reversed by 180° thanks to a special reversing mechanism (17) which sets the cap in the correct position before it is inserted into the china cup or similar (19).

At the end of the falling stage, the cap is already placed in the cup ready to be pushed down so that it adheres completely to the cup's inside and capsules it perfectly.

This stage is guaranteed by the air compressor. Both the cup and the support have small holes (20, 21) connected to each other, through which the air can flow out when suctioned by the microcompressor. This air causes a kind of eddy on the lining cap which capsules the cup adhering to it perfectly. Once the cup is lined, the special sensor (22) on the above-mentioned sucking circuit detects the presence of a different pressure compared to the atmospheric pressure (which is present only if the cup is completely lined with the cap) and closes an electric contact connected to a second inlet port to the electronic station (16); as soon as the closed contact signal arrives at this station a relay is opened thus blocking the feeding of microcompressor 13 which consequently ends its cycle, stops the suctioning and compressing, and is disabled until the cup lined with a cap, ready for use, is removed and replaced by another cup to be lined.

BRIEF DESCRIPTION OF THE DRAWINGS

FIG. 1 shows the main components of the machine of the invention. These include the movable external cylinder (1), the fixed internal cylinder (2), the stack of caps (3), the slightly cone-shaped end (4) of the internal cylinder, the cap's rim (5), one of the slots (6), one of the tabs (8) engaged in slot 6 (only one tab is shown), the top of the external cylinder (9), the springs (10) causing the cylinder to return, the pressure release valve (11), the compressed air inlet pipe (12), the microcompressor (13), the base (14) on which the cup is placed, the microswitch (15), the control station (16), the reversing mechanism (17), the cap when reversed (18), the cup in such (20) a position to be lined with the cap (19), the holes (20) in the cup and the base (21), the vacuum sensor (22), the push button (23) to start the machine (23), and the connection to the feeding circuit (24); finally, phantom line (7) indicating the vertical axis of the machine.

Figure 1:
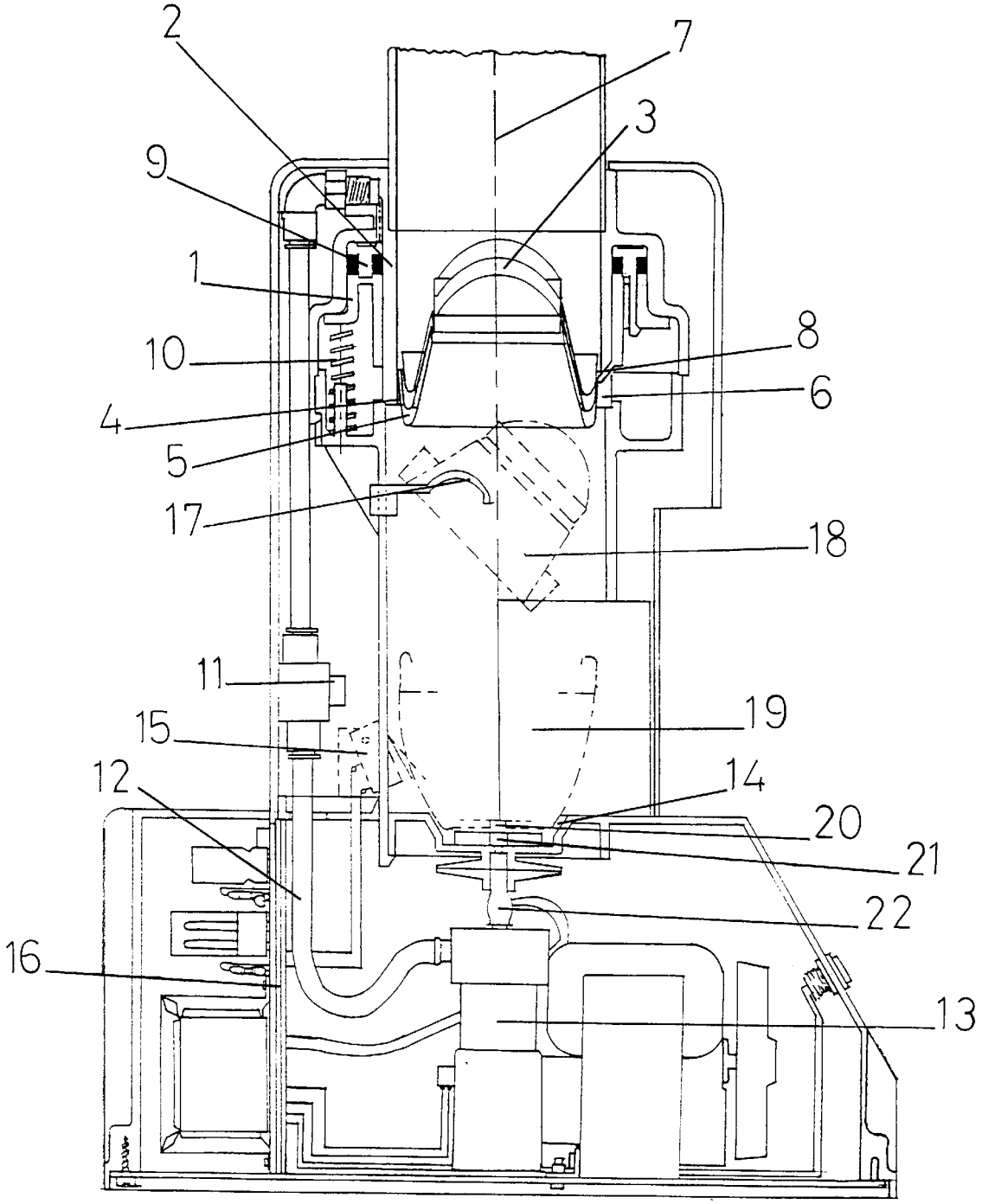
FIG. 1 is a vertical section through the machine of the invention.
Figure 2:
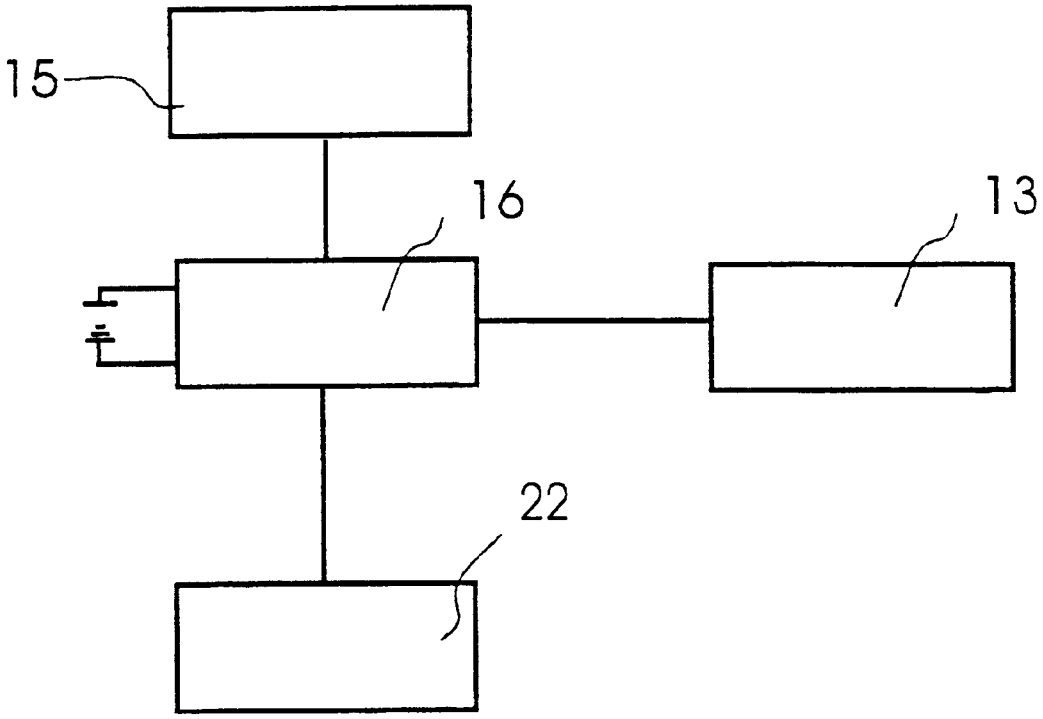
FIG. 2 is a block diagram of the electrical components of the machine.

The electrical block diagram, of FIG. 2 shows station 16, microswitch 15, vacuum sensor 22, microcompressor 13 and their connections with each other.

In fact, the construction details can be replaced by equivalent parts which may vary in form, dimensions, position of the elements, type of material used, and will nevertheless still be included in the concept of the claimed invention.

What is claimed is:

1. Machine for ejecting, reversing and positioning a hygienic cap inside a container, which comprises:

means for carrying a stack of hygienic caps (3), including a fixed internal cylinder (2) having a slightly cone-shaped lower end (4), said cylinder (2) exerting a slight pressure on a rim (5) of a lowermost cap in the stack to be ejected and a tab (8) slidably extending in a slot in said cylinder to engage said rim to eject the lowermost cap in said stack from said internal cylinder, means for moving said tab to eject the lowermost cap including an external movable cylinder (1) on which said tab is secured;

means for reversing (17) the lowermost cap during its ejection (18), causing the cap to rotate by 180° and fall by gravity into a cup (19) placed therebelow;

means for lowering the external cylinder (1) by pressure of an activation mechanism against opposition of a return spring (10), such that after a downward stroke of the internal cylinder, the external cylinder (1) is returned to its initial upper position by the return spring (10);

means to exert pressure on the external cylinder (1) in the direction of its downward stroke, and means to halt the exertion of pressure on the external cylinder when the cup (19) is completely lined with the hygienic cap.

2. Machine according to claim 1, wherein each said cup (19) has a bottom hole (20) which communicates with a hole (21) provided in a base (14) on which the cup is supported and further comprising a microcompressor (13) having an air suction duct connected to said holes, and a vacuum sensor (22) on said duct to halt operation of the microcompressor when the cup is lined with the hygienic cap.

3. Machine according to claim 2, wherein the means to exert pressure on the movable external cylinder (1) comprises a mechanism driven by compressed air and activated when the cup (19) is positioned on the base (14).

4. Machine according to claim 1, comprising a pressure release valve to release pressure on the activation mechanism after the lowermost hygienic cap (5) has been ejected, whereupon the external cylinder (1) is returned to its initial position by the return spring (10).

* * * * *